US008444008B2

(12) United States Patent
Al-Mahnna

(10) Patent No.: US 8,444,008 B2
(45) Date of Patent: May 21, 2013

(54) TISSUE HOLDER AND DISPENSER

(76) Inventor: Khaled Abdullah M. Al-Mahnna, Salmiya (KW)

( * ) Notice: Subject to any disclaimer, the term of this patent is extended or adjusted under 35 U.S.C. 154(b) by 461 days.

(21) Appl. No.: 12/724,592

(22) Filed: Mar. 16, 2010

(65) Prior Publication Data

US 2011/0226796 A1 Sep. 22, 2011

(51) Int. Cl.
*B65H 1/00* (2006.01)
*A47K 10/24* (2006.01)

(52) U.S. Cl.
USPC ..... 221/46; 221/309; 221/304; 221/303; 221/307; 221/302; 221/1; 224/539; 224/277; 224/540; 224/572; 206/233; 206/44; 248/905; 248/201

(58) Field of Classification Search
USPC ..... 206/216, 494, 45, 223, 44, 233; 221/47, 221/63, 46, 309, 304, 303, 307, 302, 1; 248/201, 248/905; 224/539, 277, 540, 572
See application file for complete search history.

(56) References Cited

U.S. PATENT DOCUMENTS

| | | | | | |
|---|---|---|---|---|---|
| 2,155,760 | A | | 4/1939 | Hy | |
| 3,301,388 | A | * | 1/1967 | Rockwell | 312/42 |
| 3,733,044 | A | | 5/1973 | Rabner | |
| 3,927,809 | A | * | 12/1975 | Klein, Sr. | 224/196 |
| 4,411,374 | A | * | 10/1983 | Hotchkiss | 221/63 |
| 4,607,809 | A | * | 8/1986 | Sineni et al. | 242/560 |
| 4,739,922 | A | * | 4/1988 | Zimmermann | 229/122.1 |
| 5,145,139 | A | * | 9/1992 | Holtsch | 248/313 |
| 5,197,705 | A | | 3/1993 | Baskas | |
| 5,494,250 | A | | 2/1996 | Chen | |
| 5,540,354 | A | * | 7/1996 | Annand | 221/52 |
| 5,957,325 | A | * | 9/1999 | Montanez | 221/131 |
| 6,170,725 | B1 | * | 1/2001 | Ganues | 224/539 |
| 6,641,100 | B2 | * | 11/2003 | Furukawa | 248/309.1 |
| 6,672,474 | B2 | * | 1/2004 | May et al. | 221/34 |
| 6,752,290 | B2 | * | 6/2004 | Tramontina | 221/46 |
| 7,296,705 | B2 | | 11/2007 | Boulet-Mazer | |
| 7,726,515 | B2 | * | 6/2010 | Sherman et al. | 221/309 |
| 2004/0245421 | A1 | * | 12/2004 | Turvey | 248/304 |
| 2005/0199690 | A1 | * | 9/2005 | Peterson | 229/122.1 |
| 2007/0119858 | A1 | * | 5/2007 | Ayoub | 221/2 |
| 2007/0262082 | A1 | * | 11/2007 | Butcher | 221/47 |

* cited by examiner

*Primary Examiner* — Gene O. Crawford
*Assistant Examiner* — Rakesh Kumar
(74) *Attorney, Agent, or Firm* — Lowe Hauptman Ham & Berner, LLP

(57) ABSTRACT

A tissue holder and dispenser includes a cuboid shaped housing having a front panel, two planer side panels and a planer rear panel as well as a planer bottom panel and an open top. The front planer panel includes a horizontal slot through which individual tissues are dispensed while one side wall includes a rectangular opening through which an empty tissue box can be ejected by pushing it out of the housing with a finger inserted through a circular opening on the opposite side wall that is aligned with the rectangular opening in the first side wall. The housing is constructed and dimensioned to hold from one to four tissue boxes with the top of each box facing a front surface of the rectangular front planer panel so that a slit in the top of the tissue box on the bottom of the housing will come into register with a slot in the lower portion of the rectangular front planer panel.

5 Claims, 3 Drawing Sheets

TISSUE HOLDER AND DISPENSER

FIELD OF THE INVENTION

This invention relates to a tissue holder and dispenser and more particularly to a tissue holder and dispenser for holding a plurality of boxes of tissues.

BACKGROUND FOR THE INVENTION

Tissue holders for holding a box of tissues and for dispensing individual tissues are well known and have been in use for many years. For example, a United States patent of J. Hy, U.S. Pat. No. 2,155,760 discloses a box holder for mounting a box upon a wall such as a box of cleansing tissues. The holder for a paste board box of the kind in which paper cleaning tissues are sold typically includes an elongated opening in a front wall for dispensing tissues. The cleaning tissues which are in the form of individual paper sheets are adapted to be withdrawn through the opening and the sheets are interfolded so that as one sheet is withdrawn it moves the leading edge of the succeeding sheet partway through the opening. As disclosed, the holder includes a panel like boarder that is rectangular in shape and which is formed with marginal flanges. The flanges stiffen the body and space it from the supporting surface against which it is mounted.

A tissue containing box holder is also disclosed in a U.S. patent of Rabner, U.S. Pat. No. 3,733,044. As disclosed, a tissue containing box holder includes first and second parallel, spaced, cross pieces that are connected by a backing plate, and fastening means for securing the plate to a vertical wall surface. The first cross piece supports at least one downwardly projecting prong which has the free end extremity thereof spaced from a longitudinally extending apex on the second cross piece at a distance less than the width of a conventional tissue holding cardboard box such as in which Kleenex is retailed. The edge portions of such a box are rigid and the walls extending between the edges are resilient. When a Kleenex box has a first side wall placed in pressure contact with the prongs and a second side wall in contact with the apex, the side walls are bowed inwardly towards one another, and any force exerted on the box in removing the tissue therefrom tends to pivot the box toward the prongs to increase the pressure engagement therewith, and prevent the box from being inadvertently displaced from the holder.

A more recent U.S. Pat. No. 5,145,139 of Holtsch discloses a holding device for containers with tissues and the like comprising a housing, an insert movable relative to the housing between a proximal position in which the container can be clamped between the insert and the housing and a distal position in which the insert is moved away from the housing so that the container can be removed from the device and a new container can be placed between the insert and the housing, and elements for elastically urging the insert toward the housing to the proximal position so that the insert can be moved away from the housing toward the distal position by overcoming a resistance of the elastic elements. The elastic elements may include at least one elastic band elastically connecting the insert with the housing.

An additional holder for box dispensers is taught by a U.S. patent of Baskas, U.S. Pat. No. 5,197,705. As disclosed the holder for a box dispenser of articles for use in a professional office or at home, comprises an L-shaped member having a shelf for receiving the box and an upstanding wall portion on which is mounted a clip. The clip is spring-biased to hold the box in place. The clip is preferably vertically moveable via telescoping members or slots to accommodate different sized boxes.

Finally, a dispensing system and assembly having a shelf integrated with one or more compartments for dispensing flexible articles is disclosed in a U.S. Pat. No. 7,296,705 of Boulet-Mazer. As disclosed therein, an assembly useable in conjunction with a plurality of flexible articles includes at least one compartment configured to hold a plurality of the flexible articles. The compartment defines an outlet configured to enable the flexible articles to be removed from the compartment through the outlet at least one at a time. The assembly includes at least one mount connected to the housing and a door. The door has a shelf surface. The assembly provides users with increased shelving and storage space, access to flexible articles, and convenience of use.

Notwithstanding a relatively large number of tissue holders and dispensers, it is presently believed that there is a need and a potential commercial market for an improved tissue holder and dispenser in accordance with the present invention. There should be a commercial market for such systems and an apparatus because the holder holds a plurality of boxes of tissues and permits one tissue to be removed at a time and when one tissue box is empty, a second box is readily moved into a position to dispense tissues. Further, the devices are durable, easily installed on a wall of a structure, convenient to use, and should be producible at a competitive price. Further, the apparatus are particularly appropriate for areas with public access such as public restrooms or the like.

BRIEF SUMMARY OF THE INVENTION

In essence a tissue holder and dispenser in accordance with the present invention holds a plurality of boxes of tissues and dispenses tissues through a generally horizontal slot in a lower portion of a front face portion thereof. The tissue holder and dispenser include a cuboid shaped housing having a generally rectangular front panel, a generally rectangular rear panel, two generally rectangular side panels, a bottom panel and an open top. Each of the front, rear and side panels include an upper and lower portion and the front panel includes a generally horizontal slot for dispensing individual tissues in the lower portion thereof. The front face panel also includes a generally U-shaped opening in an upper portion adjacent to and abutting said open top. In addition, the front panel includes a circular opening below the U-shaped opening and an oblong opening between the circular opening and the horizontal slot. Further, the first of the side panels include a generally U-shaped opening in an upper portion thereof and abutting the open top and a lower rectangular opening in a lower portion thereof adjacent to and abutting the bottom panel for removal of a box of tissues when the tissues are expended (exhausted) and the second side panel includes a generally U-shaped opening across from and aligned with the U-shaped opening in the first of the side panels while the second side panel includes a circular opening across from the rectangular opening in said first side panel for pushing a spent box of tissues out of the housing through the rectangular opening. The back panel also includes two small openings; one in an upper portion thereof and one in a lower portion for attaching the housing to an internal wall of a dwelling.

The invention will now be described in connection with the accompanying drawings wherein like reference numerals have been used to indicate like parts.

DESCRIPTION OF THE PREFERRED EMBODIMENTS OF THE INVENTION

Figure 1:
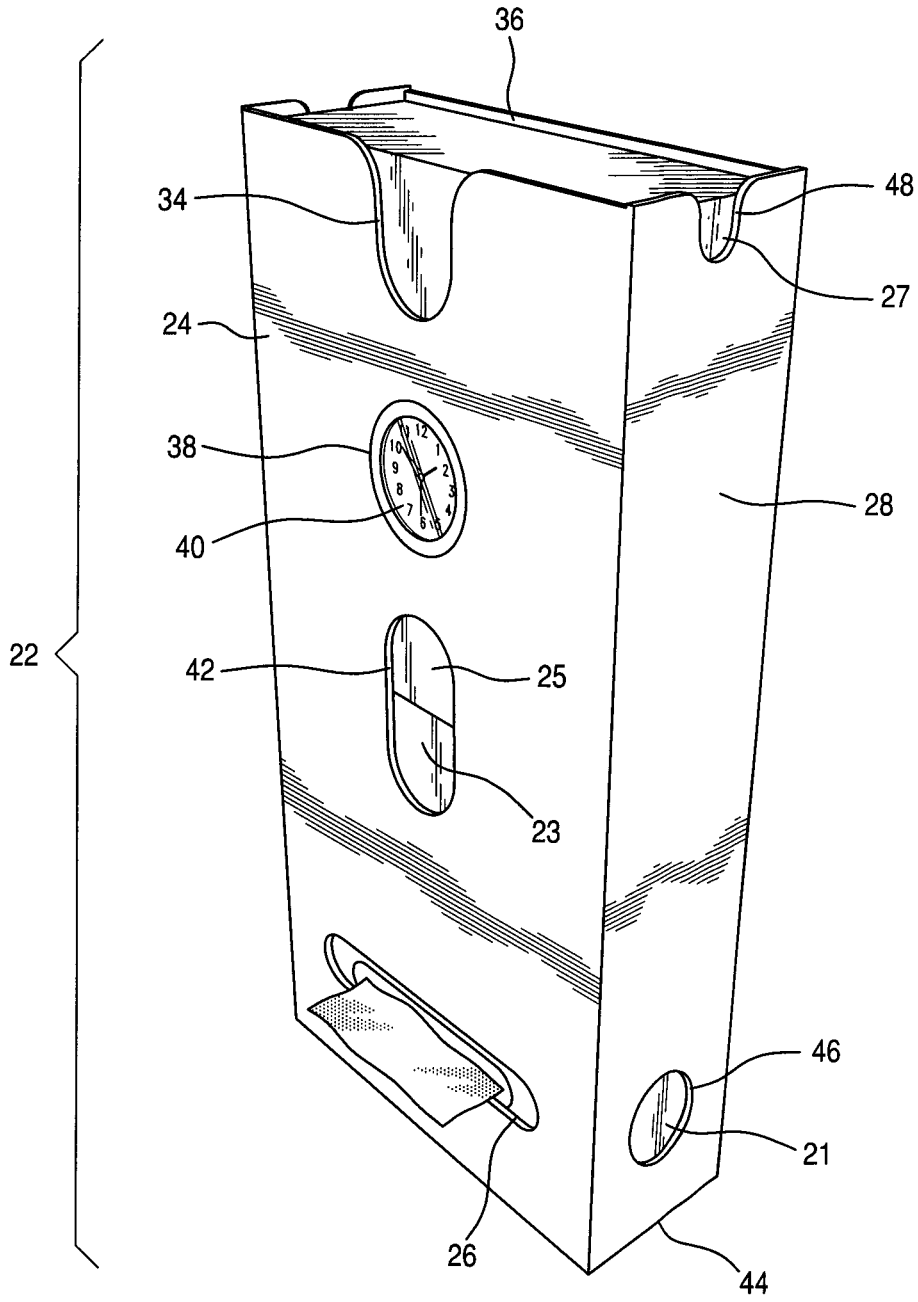
FIG. 1 is perspective view of a tissue holder and dispenser in accordance with the preferred embodiment of the invention showing the front face panel and one side panel and an open top.
Figure 2:
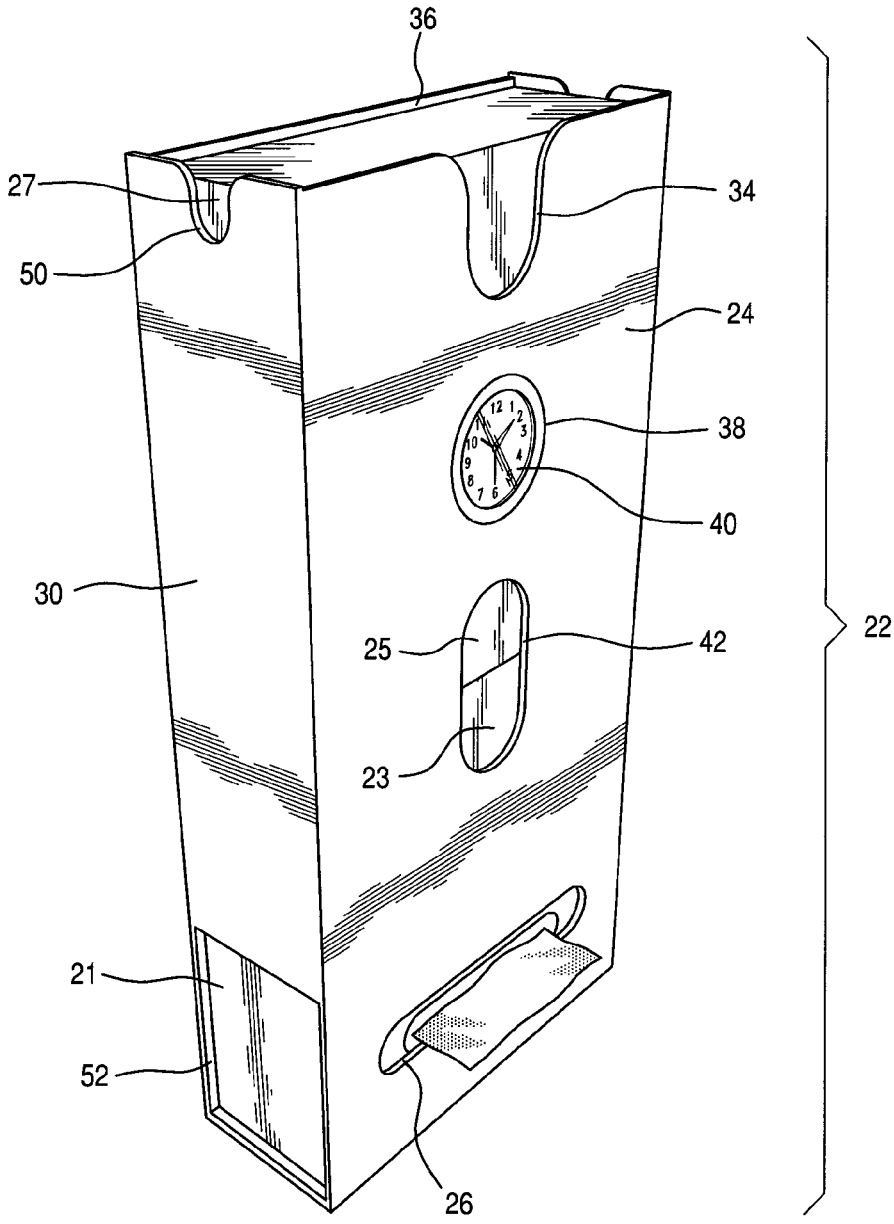
FIG. 2 is a perspective view of the tissue holder and dispenser shown in FIG. 1, but showing the other side panel face and open top.
Figure 3:
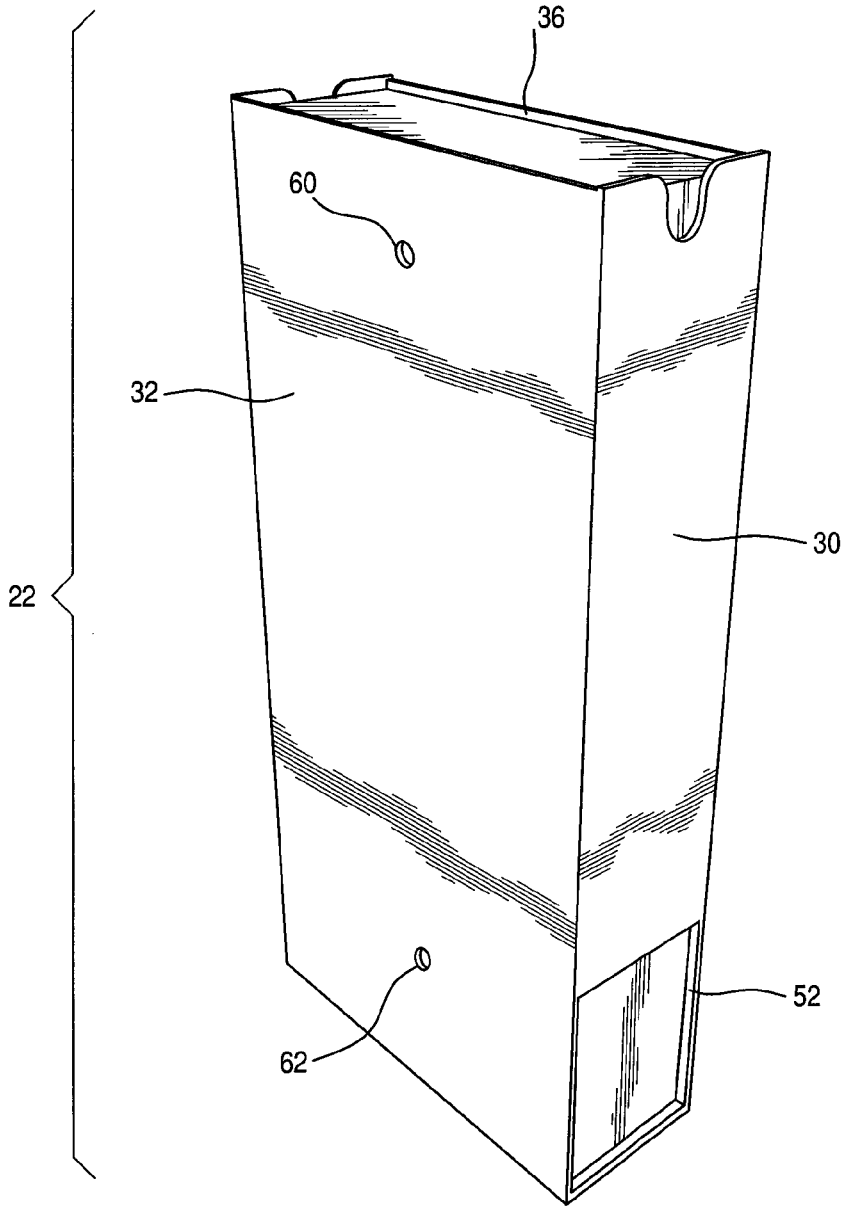
FIG. 3 is a perspective view illustrating the back panel and one side of the tissue holder and dispenser as shown in FIGS. 1 and 2.

As shown in FIGS. 1-3, a tissue holder and dispenser 20 include an outer housing 22 that is adapted to hold a plurality of boxes of tissues and in a preferred embodiment of the invention, holds between one and four boxes of tissues to dispense individual tissues from one of the boxes until they are exhausted i.e. the box is empty. As shown, the housing 22 has the shape of a rectangular prison or cuboid i.e. six flat sided shape wherein all of the angles are right angles.

The housing 22 includes a rectangular front face panel 24 that includes a generally horizontal slot 26 in a lower portion of the front face panel and centered between two rectangular side panels 28 (shown in FIG. 1) and 30 (shown in FIGS. 2 and 3). The housing 22 also includes a rectangular shaped rear panel 32 (see FIG. 3) having essentially the same dimensions as the front panel 24.

The front face panel 24 also includes a generally U-shaped opening 34 in an upper portion thereof adjacent to and abutting an open top 36. The U-shaped opening 34 is centered between the side walls 28 and 30. The front face panel 24 also includes a circular opening 38 with an analog clock 40 within the circular opening in an upper portion of the front face panel 24.

An oblong opening 42 is disposed directly under the clock 40 and is centered between the side walls 28 and 30 between the clock 40 and slot 26. The slot 26 is spaced from the bottom 44 of the housing 22 and has sufficient height to allow an individual to reach in with their fingers to grip a tissue if one is not extending outside from the front face panel. For example, each of the one to four boxes of tissue with the top of a tissue box facing the front face panel 24 with the generally horizontal slot 26 aligned with the opening in the tissue box on the bottom of the housing 22.

The four tissue boxes 21, 23, 25 and 27 are visible with the bottom tissue box 21 visible through the slot 26 and a circular opening 46 in the lower portion of the side panel 28. A second tissue box 23 is partially visible through the bottom portion of the oblong opening 42 while a third tissue box 25 is partially visible through an upper portion of the oblong opening 42. Finally, the fourth tissue box 27 is visible through the open top 36 as well as through the U-shaped opening 34 in the front panel 24.

The side panel 28 also defines an upper U-shaped opening 48 adjacent to and abutting the open top 36. The second side panel 30 has the same dimensions as the side panel 28 and also includes a U-shaped opening 50 as well as a rectangular opening 52. This rectangular opening 52 is of essentially the same size as the cross section of a tissue box so that an empty box may be ejected from the housing 22 by pushing the box out of the housing with an extending finger into the circular opening 46 in the side wall 28.

The rear panel 32 shown in FIG. 3 contains two small openings 60 and 62, one in an upper portion thereof and the other in a lower portion of the real panel 32 for fastening the housing 22 to a wall of a room or structure.

While the invention has been described in connection with its preferred embodiments, it should be recognized that changes and modifications may be made therein without departing from the scope of the appended claims.

What is claimed is:

1. A tissue holder and dispenser for holding between one and four boxes of tissues and dispensing individual tissues through a generally horizontal slot in a lower portion of a front face panel thereof, said tissue and dispenser comprising:

a cuboid shaped housing having a generally rectangular front panel, a generally rectangular rear panel, two generally rectangular side panels, a bottom panel and an open top and wherein each of said front, rear and side panels have an upper and a lower portion and said front panel includes a generally horizontal slot for dispensing individual tissues in said bottom portion thereof and a generally U-shaped opening in an upper portion adjacent to and abutting said open top;

a circular opening below said U-shaped opening and an oblong opening between said circular opening and said horizontal slot and a first of said side panels including a generally U-shaped opening in an upper portion thereof and abutting said open top and a lower rectangular opening in a lower portion thereof adjacent to and abutting said bottom panel for removal of a box of tissues when tissues are exhausted and said second side wall including a generally U-shaped opening across and aligned with said U-shaped opening in said first of said side walls and said second side panel including a circular opening across from said rectangular opening in said first side panel for pushing a spent box of tissues out of said housing and said back panel including two small openings; one in said upper portion thereof and one in said lower portion for attaching said housing to an internal wall of a dwelling;

in which said generally U-shaped opening, said circular opening and said oblong opening are centered in said front panel between said side panels; and in which said generally horizontal slot has an oblong shape, is centered between said side panels and is of sufficient size for an individual to insert their fingers to extract a single tissue.

2. A tissue holder and dispenser for holding between one and four boxes of tissues and dispensing individual tissues through a generally horizontal slot in a lower portion of a front face panel thereof according to claim 1 and wherein said housing is plastic.

3. A tissue holder and dispenser for holding between one and four boxes of tissues and dispensing individual tissues through a generally horizontal slot in a lower portion of a front face panel thereof according to claim 2 in which a clock is disposed in said circular opening in said front face panel.

4. A tissue holder and dispenser for holding between one and four boxes of tissues and dispensing individual tissues through a generally horizontal slot in a lower portion of a front face panel thereof according to claim 1 and wherein said housing is made of plywood.

5. A tissue holder and dispenser for holding between one and four boxes of tissues and dispensing individual tissues through a generally horizontal slot in a lower portion of a front face thereof, said tissue holder and dispenser consisting of:

a cuboid shaped plastic housing further consisting of an upwardly extending rectangular front panel, an upwardly extending rectangular rear panel, two upwardly extending rectangular side panels, a bottom panel and an open top and wherein each of said upwardly extending panels further consists of an upper and a lower portion and said front panel further consisting of a horizontal slot for dispensing individual tissues in said bottom portion thereof and a generally U-shaped opening in an upper portion adjacent to and abutting said open top;

a circular opening below said U-shaped opening and an analog clock disposed in said circular opening;

an oblong opening between said clock and said horizontal slot and a first of said side panels including a generally U-shaped opening in an upper portion thereof adjacent to and abutting said open top and a lower rectangular opening in said lower portion thereof adjacent to and abutting said bottom panel for removal of an empty tissue box and said second side wall including a generally U-shaped opening across from and aligned with said U-shaped opening in said first of said side panels and including a circular opening across from said rectangular opening in said first side panel for pushing an empty tissue box out of said housing and said back panel including two small openings with one of said openings in an upper portion thereof and the other of said small openings in a lower portion thereof for attaching said housing to wall of a dwelling;

in which said generally U-shaped opening, said circular opening and said oblong opening are centered in said front panel between said side panels; and in which said generally horizontal slot has an oblong shape, is centered between said side panels and is of sufficient size for an individual to insert their fingers to extract a single tissue.

* * * * *